United States Patent [19]

Onizuka et al.

[11] Patent Number: 4,818,445

[45] Date of Patent: Apr. 4, 1989

[54] APPARATUS FOR TREATING A SOLUTION OR A SLURRY SOLUTION

[75] Inventors: Masakazu Onizuka; Atsushi Tatani; Katsuhiko Yamada; Masao Hino; Nobutaka Maeda, all of Kanonshin; Tokuma Arai, Tokyo, all of Japan

[73] Assignee: Mitsubishi Jukogyo Kabushiki Kaisha, Tokyo, Japan

[21] Appl. No.: 48,682

[22] Filed: May 12, 1987

[30] Foreign Application Priority Data

| | | | |
|---|---|---|---|
| May 12, 1986 | [JP] | Japan | 61-70007[U] |
| Jun. 3, 1986 | [JP] | Japan | 61-83616[U] |
| Jun. 3, 1986 | [JP] | Japan | 61-83618[U] |
| Apr. 13, 1987 | [JP] | Japan | 62-88947 |

[51] Int. Cl.[4] ..... B01F 3/04

[52] U.S. Cl. ..... 261/87

[58] Field of Search ..... 261/87

[56] References Cited

U.S. PATENT DOCUMENTS

| | | | |
|---|---|---|---|
| 5,289 | 2/1843 | Noah | 261/87 |
| 8,665 | 1/1852 | Seitz | 261/87 |
| 190,185 | 5/1887 | Brandenburg | 261/87 |
| 1,796,278 | 3/1931 | Bakewell | 261/87 |
| 1,832,469 | 11/1931 | Neill et al. | 261/87 |
| 2,917,372 | 12/1959 | Wallin | 261/87 |
| 3,776,531 | 12/1973 | Ebner et al. | 261/87 |
| 3,779,531 | 12/1973 | White | 261/87 |
| 3,917,763 | 11/1975 | Schafer | 261/87 |
| 4,290,885 | 9/1981 | Kwak | 261/87 |

FOREIGN PATENT DOCUMENTS

| | | | |
|---|---|---|---|
| 1191339 | 4/1965 | Fed. Rep. of Germany | 261/87 |
| 1230399 | 12/1966 | Fed. Rep. of Germany | 261/87 |
| 2218134 | 10/1974 | France | 261/87 |
| 50-53949 | 5/1975 | Japan . | |
| 50-104277 | 8/1975 | Japan . | |
| 50-18401 | 7/1979 | Japan . | |
| 53-25272 | 3/1978 | Japan . | |
| 61-150047 | 9/1986 | Japan . | |

*Primary Examiner*—Tim Miles

*Attorney, Agent, or Firm*—Birch, Stewart, Kolasch & Birch

[57] ABSTRACT

The present invention relates to an apparatus for treating a solution or a slurry solution and its improved types. The apparatus of the present invention comprises a hollow rotating shaft having a sealing mechanism and a rotating mechanism at upper portions thereof, the apparatus being characterized by comprising a plurality of stirring branch pipes attached to the lower end of the hollow rotating shaft vertically downward extending into the solution in a storage tank, and a plurality of gas jet pipes disposed under the respective branch pipes, the gas jet pipes extending vertically downward and being opened at the lower ends thereof, whereby the shaft and the stirring branch pipes are rotated, while a gas is jetted from openings of the gas jet pipes through the sealing mechanism, the hollow rotating shaft and the branch pipes. The improved types of the above mentioned apparatus include an apparatus in which a plurality of stirring blades are additionally provided under the branch pipes, an apparatus in which a wash water feed pipe is additionally provided in the hollow rotating shaft, and the like.

8 Claims, 9 Drawing Sheets

APPARATUS FOR TREATING A SOLUTION OR A SLURRY SOLUTION

FIELD OF THE INVENTION AND RELATED ART STATEMENT

The present invention relates to an apparatus for treating a solution or a slurry solution by jetting a gas thereinto. More particularly, the present invention relates to a treating apparatus applicable to a process in which air is fed to an absorbing liquid in a wet exhaust gas desulfurizing installation to oxidize the sulfites in the liquid.

Heretofore, as apparatuses for oxidizing sulfites which have been produced in the wet exhaust gas desulfurizing installation, the following systems have been employed: A system in which as shown in FIG. 10, air feed pipe 22 having a number of jet holes 23 is disposed above the bottom of storage tank 6 for solution 10' to be treated, or in which as shown in FIG. 11, rotational stirring blade 24 is additionally disposed above the lower portion of pipe 22 so as to accelerlate a gas/solution contact, whereby the sulfites in the solution are oxidized; and another system in which as shown in FIG. 12, a hollow rotational stirring blade having a number of gas jet holes 20 is used to accelerate the jet of gas 11 and the formation of fine gas bubbles, whereby an oxidizing treatment is accomplished.

In the former system of FIG. 11, most of gas 11 is jetted through jet holes 23 in the form of relatively large gas bubbles and the formation of the fine gas bubbles by rotational stirring blade 24 is not expected, and thus when the fine gas bubbles are desired, it is necessary to provide a number of small gas jet holes 23.

In particular, this technique has the drawback in that the stirring effect of stirring blade 24 is lowered by the rise of the gas bubbles jetted through gas jet holes 23 in FIG. 11, so that solids are deposited on the bottom of solution storage tank 6 and gas jet holes 23 are locally clogged therewith, which fact leads to an inconveniently increase in the original pressure for gas feed.

In the latter system of FIG. 12, the gas jetting means are provided in the stirring blade in order to simultaneously carry out a gas jet stirring and a mechanical stirring and to thereby uniformly disperse gas 11 into solution 10' to be treated. In the case of this system, the apparatus structure is simpler and a gas/solution contact efficiency is also higher than in the former system. FIG. 12 is the illustrative view of the latter system. In solution storage tank 6 in this apparatus, solution 10' to be treated is received, and stirring branch pipe 21 having a number of gas jet holes 20 is attached to the lower end of hollow rotating shaft 3. Branch pipe 21 is adapted to be rotated by rotating mechanism 9, and gas 11 can be jetted from gas jet holes 20 through hollow rotating shaft 3 and stirring branch pipe 21. This treating apparatus can feed gas 11 to a gaseous phase section formed behind stirring branch pipe 21 and can sever the gaseous phase setion along the edge portion thereof in order to produce sufficiently fine gas bubbles.

In this way, the treating apparatus shown in FIG. 12 can sever the gaseous phase section along the edge portion thereof to form the fine gas bubbles and in consequence it can improve a gas/solution contact efficiency.

However, when this apparatus is applied to the treatment of a slurry solution, it is inevitable that splashes of the slurry solution gain entry into stirring branch pipe 21 through the gas jet holes 20. As a result, scales appear in stirring branch pipe 21 and around the gas jet holes 20, with the result that the gas jet holes 20 are clogged therewith disadvantageously.

Further, when the feed of the gas 11 is stopped, slurry solution tends to stream into branch pipe 21, so that solid constituents precipitate therein, thereby producing the scales. Owing to such an occurrence of the scales, flow rates of the gas jetted through respective branches 21 will not be uniformed, and these branches will begin to vibrate and finally will become incapable of rotating. FIG. 13 exemplifies an instance in which scaling has occurred in stirring branch pipe 21. Hard scale 25 clings to the upper portions of the inside wall in branch pipe 21 which correspond to gas jet holes 20. Such scales are too hard to be removed by simply washing with water. In addition, mixture 26, which is comprised of a soft scale and a hard scale, sticks to lower portions of the inside wall between the respective gas jet holes 20 of branch pipe 21 and to the end portions of branch pipe 21, and some of the gas jet holes 20 are clogged with hard scale 25.

OBJECT AND SUMMARY OF THE INVENTION

In overcoming the above mentioned problems, the present invention has been achieved. One object of the present invention is to provide a treating apparatus in which fine gas bubbles are jetted into a solution or a slurry solution in order to improve a gas/solution contact efficiency.

Another object of the present invention is to provide an apparatus for treating a solution or a slurry solution which inhibits a scale from occurring in stirring branch pipes, in contrast to conventional techniques, in order to prevent gas jet holes from being clogged with the scale and to thereby enable a long-term operation.

Constitutions to accomplish the above mentioned objects are as follows:

(1) An apparatus for treating a solution or a slurry solution which comprises a hollow rotating shaft having a sealing mechanism and a rotating mechanism at upper portions thereof, the apparatus being characterized by comprising a plurality of stirring branch pipes attached to the lower end of the hollow rotating shaft, and a plurality of gas jet pipes disposed under the respective branch pipes, the gas jet pipes extending vertically downward from the respective branch pipes and being opened at the lower ends thereof, whereby the shaft and the stirring branch pipes are rotated, while a gas is jetted from openings of the gas jet pipes through the sealing mechanism, the hollow rotating shaft and the branch pipes.

In the system of the present invention, it is intended that the gas jet portions are rotated in order to form fine uniform gas bubbles by the turning force and to thereby disperse them throughout in the solution or the slurry solution. In addition, this system has the function that the fine gas bubbles of the jetted gas are produced from a vigorous flow section or an eddy flow section produced behind each gas jet pipe by the rotation thereof, so that a gas/solution contact efficiency is heightened.

That is, according to the present invention, the fine bubbles of the jetted gas can be formed and in consequence the gas/solution contact efficiency can be improved.

(2) An apparatus for treating a solution or a slurry solution which comprises a hollow rotating shaft having a sealing mechanism and a rotating mechanism at upper portions thereof, the apparatus being characterized by comprising a plurality of stirring blades attached to the lower end of the hollow rotating shaft, a plurality of stirring branch pipes attached to the hollow rotating shaft above the stirring blade, and a plurality of gas jet pipes disposed under the respective branch pipes, the gas jet pipes extending vertically downward from the respective branch pipes and being opened at the lower ends thereof, whereby the shaft, the stirring blades and the stirring branch pipes are rotated, while a gas is jetted from openings of the gas jet pipes through the sealing mechanism, the hollow rotating shaft and the branch pipes.

In the present invention, since the plurality of stirring blades are rotated, solids can be prevented from precipitating on the bottom of the solution storage tank. Further, since the gas jet holes are rotated, the gas bubbles can be contacted effectively with the solution or the slurry solution.

According to the present invention, the stirring blades are located under the gas jet portions, and therefore the solids can be inhibited from precipitating on the bottom of the storage tank. In addition, the gas is jetted from the gas jet pipes each having a predetermined length, while the branch pipes are rotated, and therefore the uniform fine bubbles can be formed, with the result that the effect of the gas/solution contact can be heightened.

(3) An apparatus for treating a solution or a slurry solution which comprises a hollow rotating shaft having a sealing mechanism and a rotating mechanism at upper portions thereof, the apparatus being characterized by comprising a stirring rod attached to the lower end of the hollow rotating shaft, a plurality of branch pipes which extend from the hollow rotating shaft to the rod, and a plurality of gas jet pipes fixedly attached to the stirring rod, the gas jet pipes extending vertically downward from the respective branch pipes and being opened at the lower ends thereof, whereby the shaft, the rod and the stirring branch pipes are rotated, while a gas is jetted from openings of the gas jet pipes through the sealing mechanism, the hollow rotating shaft and the branch pipes so as to feed the gas to a gaseous phase section formed behind the stirring rod.

According to the present invention, the fine gas bubbles can be formed by sucking the fed gas into the gaseous phase section formed behind the stirring rod and the gas jet pipes, and by severing the gaseous phase section along the edge portion thereof, with the result that a high gas/solution contact efficiency can be retained. In addition, this constitution enables splashes, which have gotten into the gas jet pipes, to downward flow, so that they can be discharged therefrom promptly.

(4) An apparatus for treating a solution or a slurry solution which comprises a hollow rotating shaft having a sealing mechanism and a rotating mechanism at upper portions thereof, the apparatus being characterized by comprising a stirring rod attached to the lower end of the hollow rotating shaft, a plurality of branch pipes which extend from the hollow rotating shaft to the rod, a plurality of gas jet pipes fixedly attached to the stirring rod, the gas jet pipes extending vertically downward from the respective branch pipes and being opened at the lower ends thereof, and a wash water feed pipe provided in the hollow rotating shaft, branched tip portions of the wash water feed pipe being each placed in each branch pipe.

In the present invention, the wash water can be fed to the respective branch pipes through the wash water feed pipe in order to wet the inside walls of the gas jet pipes, whereby it is possible to prevent the splashes coming into the pipes from obstinately sticking to the inside walls thereof and to thereby release the splashes therefrom at an early stage.

According to the present invention, the inside walls of the pipes are wetted with the wash water, thereby further ensuring the above function. In addition, the solution which has streamed into the pipes at the termination of the operation can be easily discharged when the operation resumed. As a result, scaling can be prevented from developing in pipes such as the gas jet pipes, so that the solution or the slurry solution can be treated in a stable state under a high gas/solution contact efficiency for a long period of time.

DETAILED DESCRIPTION OF PREFERRED EMBODIMENTS

First Embodiment:

A first embodiment of the present invention will be described with reference to FIG. 1.

Figure 1:
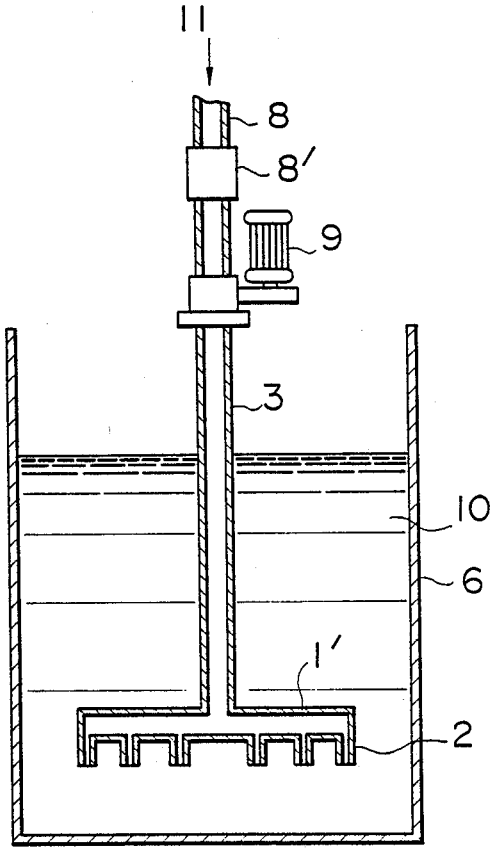
FIGS. 1, 2 and 5 to 7 are schematic views showing embodiments of an apparatus for treating a solution or a slurry solution in accordance with the present invention.

In FIG. 1, gas feed pipe 8 is connected to rotating hollow shaft 3 with the interposition of sealing mechanism 8', and a plurality of stirring branch pipes 1' are attached to the lower end of rotating hollow shaft 3. Each of the branch pipes 1' is provided with a plurality of gas jet pipes 2 being opened at the lower ends thereof. While gas 11 fed through gas feed pipe 8 is jetted from the holes of gas jet pipe 2 through rotating hollow shaft 3 and branch pipes 1', rotating hollow shaft 3 is rotated by means of rotating mechanism 9 in order to bring solution or slurry solution 10 in storage tank 6 into contact with the jetted gas.

Figure 2:
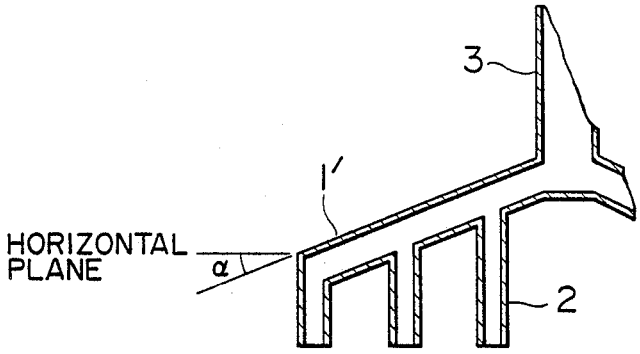

As shown in FIG. 1, the length of each gas jet pipes 2 is greater than the jump height of solution splashes, and therefore the problem of the splashes can be solved effectively. However, when the solution or the slurry solution which particularly contains solid constituents therein, streams into the horizontal stirring branch pipes 1' at the termination of the operation, and when it is attempted to discharge the solution or the slurry solution from the pipes, such an attempt cannot be carried out successfully. Accordingly, it is intended that each stirring branch pipe 1' in FIG. 1 is inclined by an angle of $\alpha$ to a horizontal plane as shown in FIG. 2. This constitution permits the solution or the slurry solution coming into the pipes to be discharged therefrom smoothly and perfectly at the resumption of the treating operation.

Figure 3:
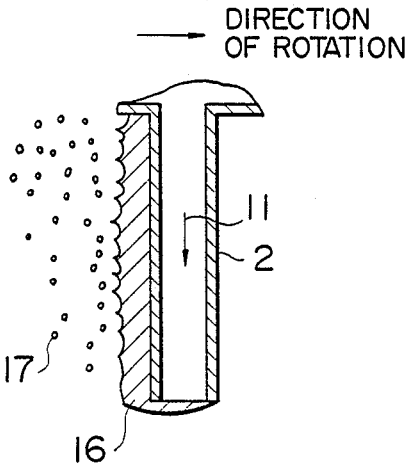
FIGS. 3, 4(A) and 4(B) are sectional views illustrating a generation state of fine gas bubbles through the gas jet pipes, FIG. 4(B) being a cross-sectional view of FIG. 4(A)
Figure 4A:
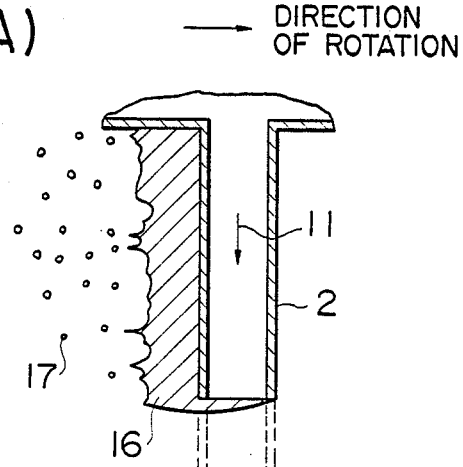
Figure 4B:
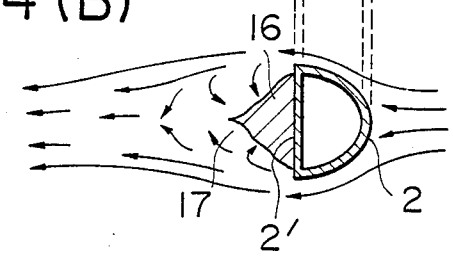

FIGS. 3, 4(A) and 4(B) show the circumstances that when gas jet pipe 2 is moved in the rotational direction indicated by the arrow, gaseous phase section 16 is formed, as in the case of a stirring rod in FIG. 8 which will be described hereinafter. FIG. 3 is concerned with an embodiment using gas jet pipe 2 which is circular in its sectional view, and FIGS. 4(A) and 4(B) are concerned with an embodiment using gas jet pipe 2 in which its front surface and back surface in the moving direction are convexly curved and flat, respectively, as most easily understood from FIG. 4(B). When gas jet pipe 2 shown in FIG. 4(B) is used, gas 11 jetted from the opening of pipe 2 is sucked into gaseous phase section 16 which is formed behind flat surface 2' of the pipe, and gaseous phase section 16 is finely severed along its edge portion 17 by an eddy force generated with the aid of the rotary motion of the pipe in order to form substantially uniform fine bubbles 18. This embodiment in FIGS. 4(A) and 4(B) can further improve a gas contact efficiency than the gas jet pipe in FIG. 3 which is circular in the sectional view.

Such a sectional shape as the gas jet pipe in FIG. 4(B) can be applied to a stirring rod in FIGS. 6 and 7 which will be described hereinafter.

Second Embodiment:

A second embodiment of the present invention will be described in detail in reference to FIG. 5.

Figure 5:
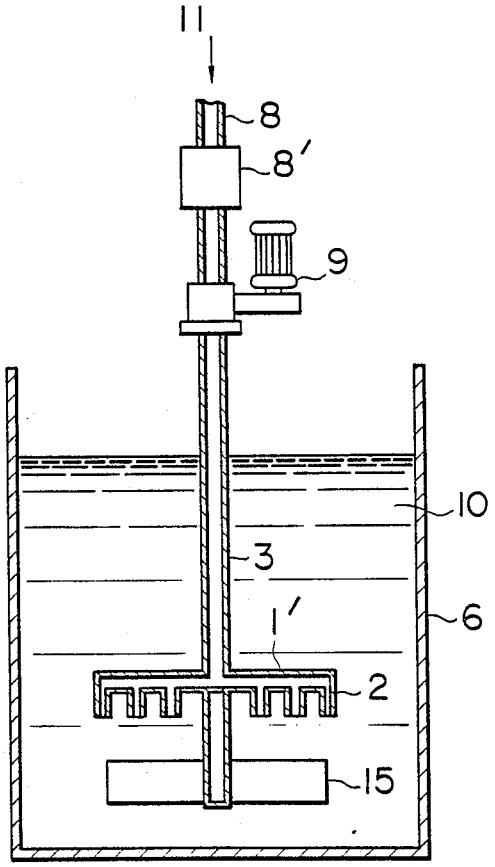

In an apparatus shown in FIG. 5, gas feed pipe 8 is connected to rotating hollow shaft 3 with the interposition of sealing mechanism 8', and a plurality of stirring blades 15 for stirring a solution or slurry solution 10 in storage tank 6 are attached to the lower end of rotating hollow shaft 3. A plurality of stirring branch pipes 1' are attached to rotating hollow shaft 3 above the stirring blades 15, and each branch pipes 1' is provided with a plurality of gas jet pipes 2 which are opened at their lower ends. According to this apparatus, rotating hollow shaft 3 is rotated by rotating mechanism 9, while the gas 11 delivered through gas feed pipe 8 is jetted from the gas jet pipes 2 via rotating hollow shaft 3 and the branch pipes 1', in order to stir solution 10 in storage tank 6 and to thereby carry out a gas/solution contact treatment.

The apparatus in FIG. 5 is a variation of the embodiment in FIG. 1, and in FIG. 5, in which hollow rotating shaft 3 is downward prolonged and the stirring blades 15 are attached to the prolonged portion thereof. In consequence, solids are inhibited from precipitating on the bottom of storage tank 6, and the solid concentration in solution 10 in the vicinity of the gas jet pipes 2 is lowered in order to decrease the trouble due to splashes in the gas jet pipes 2.

The variations shown in FIG. 2 and FIGS. 4(A) and 4(B) can be applied also to the stirring branch pipes 1' and the gas jet pipes 2 of this embodiment.

Figure 6:
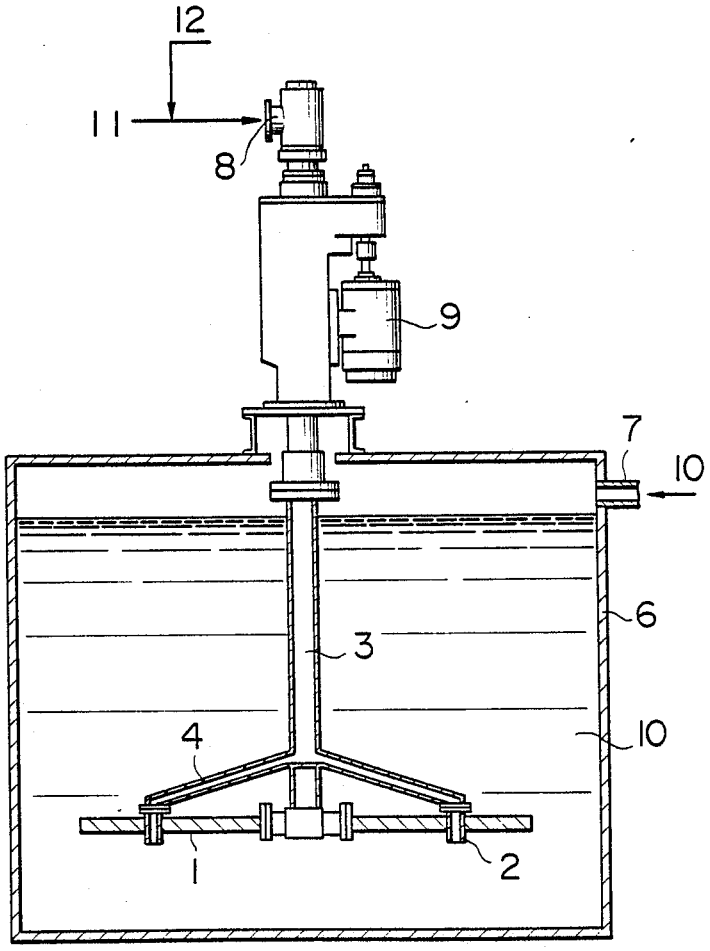

Third Embodiment:

FIG. 6 shows a schematic view of a third embodiment for treating a solution or a slurry solution in accordance with the present invention. Solution or slurry solution 10 is guided to storage tank 6 through feed orifice 7. Horizontal stirring rod 1 is attached to the lower end of hollow rotating shaft 3 downward extending in solution 10, and a plurality of gas jet pipes 2, which extend vertically downward, are fixedly attached to stirring rod 1 in the middle portions thereof. These gas jet pipes 2 are connected to hollow rotating shaft 3 with the interposition of branch pipes 4. Gas 11 is jetted into solution or slurry solution 10 through gas feed pipe 8 disposed above hollow rotating shaft 3, the latter member 3, the branch pipes 4 and the gas jet pipes 2. On the other hand, stirring rod 1 rotated by rotating mechanism 9 forms a gaseous phase section behind rod 1 itself, and gas 11 is fed to this gaseous phase section through the gas jet pipes 2.

Figure 8:
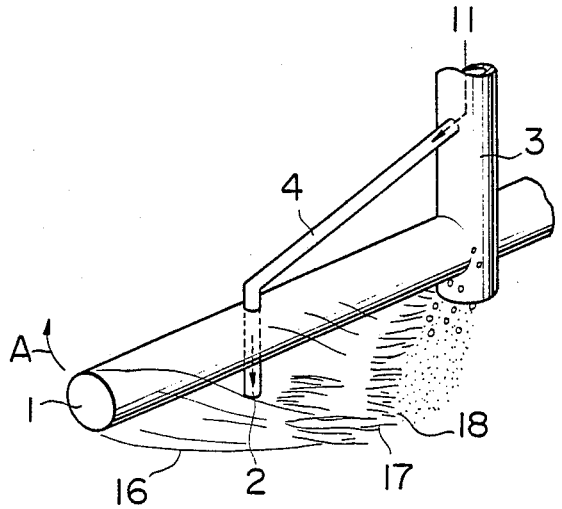
FIG. 8 is a perspective view illustrating the generation state of the fine gas bubbles in the apparatus shown in FIG. 6.

FIG. 8 shows generation circumstances of gas bubbles in the apparatus shown in FIG. 6. When stirring rod 1 is rotated in the direction of arrow A at a rotational speed of 50 to 150 rpm, with gas 11 jetted through the gas jet pipes 2, gaseous phase section 16 is formed all over the back surface of stirring rod 1. Gaseous phase section 16 is finely severed along its edge portion 17, so that most of the gas in section 16 is changed into fine gas bubbles 18. In this case, gaseous phase section 16 in the vicinity of rotating shaft 3 is narrow, and therefore at times the large gas bubbles are locally produced therein.

The gas jet pipes 2 may be disposed at arbitrary positions on stirring rod 1, to the extent that these positions are not close to rotating shaft 3 where the gaseous phase section is narrow. Further, openings of the gas jet pipes 2 are provided so as to be located under the lower surface of stirring rod 1, and the gas jet pipes 2 can be extended downward within the range in which gas 11 can be fed stably to the gaseous phase section. The gaseous phase section is also formed behind each gas jet pipe 2, wherein such would contribute to the formation of the fine gas bubbles.

During the treating operation, gas 11 is jetted as shown in FIG. 8, and so the solution or the slurry solution does not flow backward into the gas jet pipes 2. However, it is inevitable that on occasions splashes generated at the openings of the pipes 2 would gain entry into the pipes against the flow of the gas. Unless the splashes are discharged from the pipes at an early stage, scales will develop therein. For this reason, the present invention contemplates that the gas jet pipes 2 are extended downward so as to dischage the splashes early from the pipes. Therefore, a length of each gas jet pipe 2 should be determined, taking the height of the splash jump into consideration. In addition, the gas jet pipes 2 should be inclined within the range which does not prevent a downward natural stream of the splashes, which results from the weight thereof.

Further, when the inside walls of the gas jet pipes 2 are wetted, the splashes which have gained entry into the pipes 2 are prevented from obstinately adhering to the walls and the splashes can be discharged early therefrom. In the apparatus in FIG. 6, a conduit for wash water 12 is connected to a conduit for feeding gas 11 to hollow rotating shaft 3, so as to feed wash water 12 to the gas jet pipes 2 intermittently or continuously, with the result that the inside walls of the gas jet pipes 2 can be wetted.

When the treating operation is stopped, solution or the slurry solution 10 flows into the gas jet pipes 2, the branch pipes 4 and hollow rotating shaft 3, but the development of the scales can be avoided by washing them with wash water 12. Usually, when the slurry solution flows thereinto, most of the solids having large specific gravities precipitate on the bottom of storage tank 6 and therefore these solids scarcely come into the pipes. However, for the purposes of avoiding the precipitation of the solids on the pipes and facilitating the washing operation of the pipes at the resumption of the treating operation, it is preferred that the pipes into which the slurry solution will flow, are constituted vertically or inclinatorily.

In this connection, the variations shown in FIG. 2 and FIGS. 4(A) and 4(B) can be applied to the branch pipes and the gas jet pipes in this embodiment.

Figure 7:
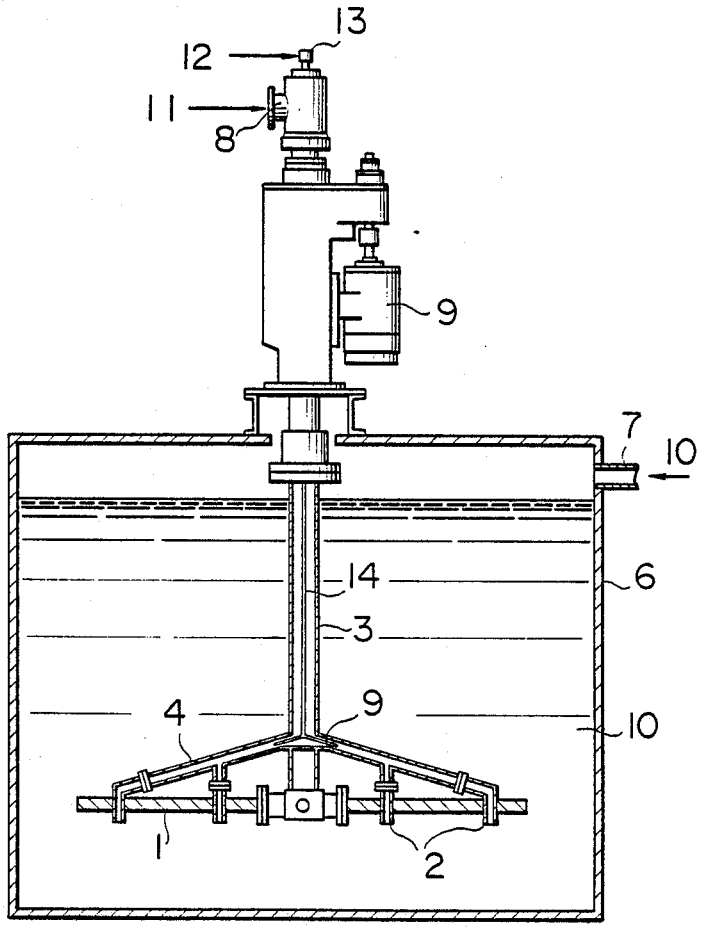

Fourth Embodiment:

FIG. 7 shows a fourth embodiment for treating a solution or a slurry solution in accordance with the present invention.

Figure 9:
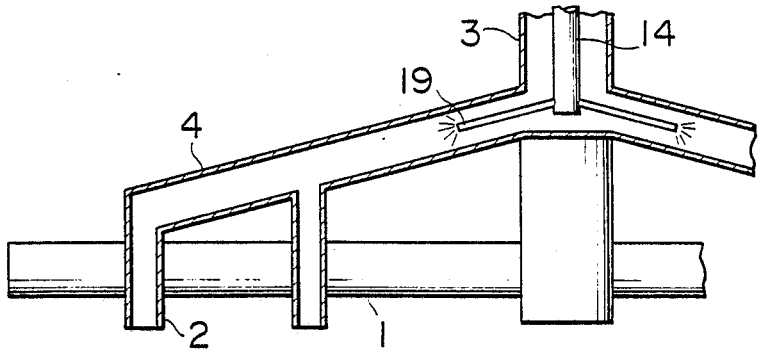
FIG. 9 is a sectional view showing wash water nozzles disposed in the branch pipes of the apparatus in FIG. 7.
Figure 10:
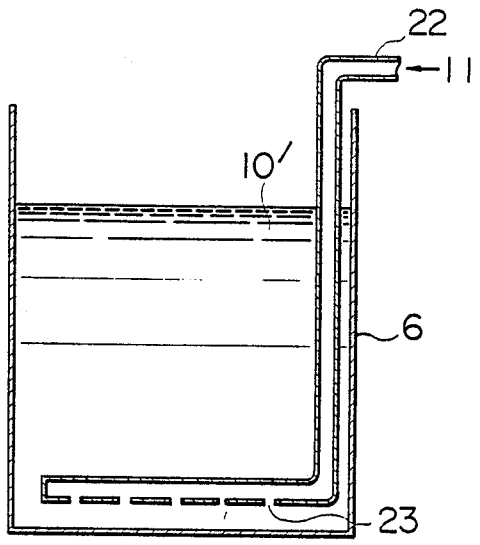
FIG. 10 PRIOR ART
FIGS. 10 to 12 are schematic views of conventional apparatuses.
Figure 11:
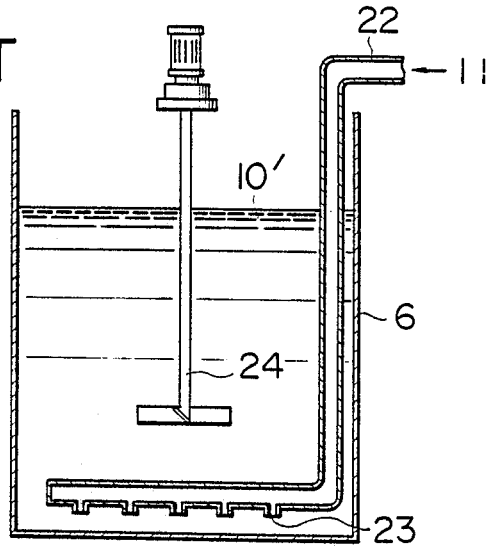
FIG. 11 PRIOR ART

Different points than in FIG. 6 are that two gas jet pipes 2 are mounted on one stirring rod 1 and that wash water feed pipe 14 is placed in hollow rotating shaft 3 and wash water nozzles 19 of feed pipe 14 are opened in the vicinity of the inlets of branch pipes 4. FIG. 9 is an enlarged view illustrating the wash water nozzles 19. The employment of such a constitution permits ensuring the feed of gas 11 and uniformly jetting wash water 12 into the branch pipes 4 and the gas jet pipes 2, so that a wet state can always be maintained all over the inside walls of the pipes 2 and 4.

Application Embodiment 1:

By the use of the apparatus in FIG. 6, air is jetted into an absorbing solution containing calcium sulfite which had been prepared in a wet exhaust gas desulfurizing installation, in order to carry out an oxidation treatment of calcium sulfite. The treating construction is as follows: The absorbing solution is first poured into a 6-m-wide and 4-m-long storage tank, until the depth of the absorbing solution has reached a level of 4 m. Four stirring rods are horizontally attached to the lower end of a hollow rotating shaft having a diameter of 114.3 mm, the size of each stirring rod being 60.5 mm in diameter and 1,150 mm in length (from the center of the rotating shaft). Each gas jet pipe has an inside diameter of 22.7 mm and an outside diameter of 27.2 mm, and the length of its vertical portion is 250 mm. Further, each gas jet pipe is disposed at a position on the stirring rod, projecting 100 mm downward from the lower surface of the stirring rod, this position of the gas jet pipe thereon being a point which is 300 mm close to the center of the rod from its end portion. Furthermore, a branch pipe for connecting the gas jet pipe to the rotating shaft is inclined at an angle of 15° to a horizontal plane. The attachment position of the stirring rod is 500 mm above the bottom of the storage tank.

Conditions for treatment are as follows: A concentration of the absorbing slurry solution is 17 wt % (as gypsum), a temperature of the slurry solution is within the range of 48° to 52° C., throughout the solution is 3.7 kgmol/h in term of sulfites, a rotational speed of the stirring rod is 60 rpm, a feed rate of air is 400 $m^3N/h$, a jet speed of air is 61 m/sec (at 50° C.), and the operation of the apparatus is carried out continuously for 700 hours (about 1 month).

In the case of this operation, an oxidation ratio of the sulfites is 100%. For the purpose of inspecting the inside walls of the gas jet pipes, the slurry solution is drawn out from the storage tank, while the aeration is kept up. The inside walls of the four gas jet pipes all has a similar thin gypsum scale over a length of about 40 mm from ends of the openings.

In another case, the operation is continued under similar conditions for 1,500 hours (about 2 months), but the developing state of the scale is similar to that of the above case, and any particular development of the scale is not observed.

Application Embodiment 2:

An oxidation treatment of sulfites is carried out by the use of the same apparatus and under the same conditions as in Application Embodiment 1 except that wash water is fed thereto at a flow rate of 30 l/h for 10 seconds every minute.

In the case of the operation for 700 hours (about 1 month), an oxidation ratio of the sulfites is 100%. Further, for the inspection of the inside walls of gas jet pipes, a slurry solution is drawn out from a storage tank, while aeration and the feed of wash water are retained. On the inside walls of the gas jet pipes, the generation of a scale is not found anywhere.

Figure 12:
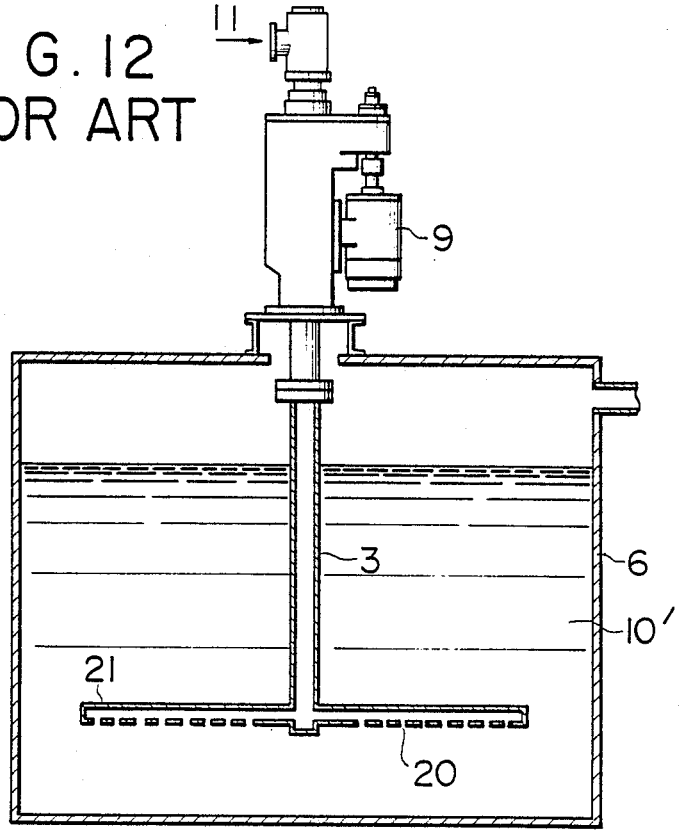
FIG. 12 PRIOR ART

Comparative Embodiment 1:

A treatment is carried out by the use of the same apparatus as in FIG. 12 and under the same conditions as in Application Embodiment 1.

The apparatus used in this comparative embodiment is different from the one shown in FIG. 6 in that the stirring rods (corresponding to stirring branch pipes) are hollow and that 8 gas jet holes each having a diameter of 8 mm are provided under each stirring rod. Conditions for operation are the same as in Application Embodiment 1 except that a jet rate of air through the gas jet holes is 60 m/sec.

Figure 13:
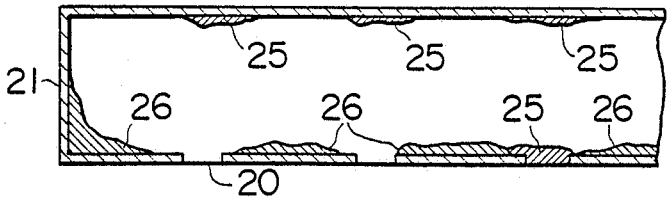
FIG. 13 is a sectional view showing scales which have developed in the hollow stirring rod in FIG. 12.

After 50 hours has elapsed, the operation is stopped owing to the vibration of the appratus itself. At this time, an oxidation ratio of sulfites is 100%. The inside walls of the hollow stirring rods (the stirring branch pipes) are inspected, and it is found that a hard scale adhered to portions of the upper wall in each rod corresponding to the gas jet holes and that 2 to 4 of the jet holes in each stirring rod were clogged with the hard scale. In addition, a mixture of the hard scale and a soft scale adhered to other portions in each rod, as shown in FIG. 13. The occurrence of the hard scale on the upper walls of the rods indicates that splashes of the solution have clung to the walls. With regard to a jump height of the splashes, there is a difference between the gas jet pipes of Application Embodiment 1 and the gas jet holes of the above stirring rods, and this difference is considered to be attributable to a structural distinction between these pipes and holes.

Comparative Embodiment 2:

An oxidation treatment of sulfites is carried out by the use of the same apparatus and under the same operating conditions as in Comparative Embodiment 1, and under the same washing conditions as in Application Embodiment 2.

For comparison, after 50 hours has elapsed, the operation is stopped as in Comparative Embodiment 1, though such a vibration as in Comparative Embodiment 1 did not take place. At this time, an oxidation ratio of the sulfites is 100%. The inside walls of hollow stirring rods (stirring branch rods) are inspected, and it is found that two gas jet holes in the vicinity of a rorating shaft and inside wall portions around these holes has no scale and thus they remained clear, but the two jet holes of each stirring rod which are further away from the rotating shaft are clogged with the scale, and the other adhering state of the scale is substantially similar to that of Comparative Embodiment 1. Therefore, it can be presumed that the apparatus will soon begin to vibrate.

We claim:

1. An apparatus for treating a solution or a slurry which comprises a container, a hollow shaft rotably disposed within said container, a plurality of hollow stirring branch pipes extending from and communicating with the lower end of said shaft, a plurality of hollow gas jet pipes extending from said respective branch pipes toward the bottom of the container an being opened at the lower ends thereof, wherein with regard to said gas jet pipes, the front surfaces and back surface thereof are convexly curved and flat, respectively, in a cross-sectional view, a means for sealing said shaft and a means for rotating said shaft, whereby as said shaft is rotated, a gas, which is introduced into said shaft is jetted from openings of said jet pipes through said sealing means, said shaft and said branch pipes, so as to feed said gas to a gaseous phase section formed behind each of said jet pipes.

2. An apparatus for treating a solution or a slurry solution according to claim 1 wherein said respective branch pipes are inclined to a horizontal line.

3. An apparatus for treating a solution or a slurry solution which comprises a container, a hollow shaft rotably disposed within said container, a plurality of stirring blades extending from and communicating with the lower end of said shaft, a plurality of hollow stirring branch pipes extending from and communicating with said shaft above said blades, a plurality of hollow gas jet pipes extending from said respective branch pipes toward the bottom of the container an being opened at the lower ends thereof, wherein with regard to said gas jet pipes, the front surfaces and back surfaces thereof are convexly curved and flat, respectively, in a cross-sectional view, a means for sealing said shaft and a means for rotating said shaft, whereby as said shaft is rotated, a gas, which is introduced into said shaft is jetted from openings of said jet pipes through said sealing means, said shaft and said branch pipes, so as to feed said gas to a gaseous phase section formed behind each of said jet pipes.

4. An apparatus for treating a solution or a slurry solution according to claim 3 wherein said respective branch pipes are inclined to a horizontal line.

5. An apparatus for treating a solution or a slurry solution which comprises a container, a hollow shaft rotably disposed within said container, a stirring rod extending from and communicating with the lower end of said shaft, a plurality of hollow branch pipes extending from and communicating with said shaft above said rod, a plurality of hollow gas jet pipes fixedly attached to said rod, extending from said respective branch pipes toward the bottom of the container and being opened at the lower ends thereof, a means for sealing said shaft and a means for rotating said shaft, whereby as said shaft is rotated, a gas, which is introduced into said shaft is jetted from openings of said jet pipes through said sealing means, said shaft and said branch pipes so as to feed said gas to a gaseous phase section from behind said rod.

6. An apparatus for treating a solution or a slurry solution according to claim 5 wherein with regard to said gas jet pipes, their front surfaces and their back surfaces are convexly curved and flat, respectively, in a cross-sectional view.

7. An apparatus for treating a solution or a slurry solution according to claim 5 wherein said respective branch pipes are inclined to a horizontal line.

8. An apparatus for treating a solution or a slurry solution which comprises a container, a hollow shaft rotably disposed within said container, a stirring rod extending from and communicating with the lower end of said shaft, a plurality of hollow branch pipes extending from and communicating with said shaft above said rod, a plurality of hollow gas jet pipes fixedly attached to said rod, extending from each of said branch pipes toward the bottom of the container and being opened at the lower ends thereof, a means for sealing said shaft and a means for rotating said shaft, and a wash water feed pipe provided in said shaft, branched tip portions of said wash water feed pipe being each placed in each branch pipe.

* * * * *